US006668472B2

(12) United States Patent
Bierwith

(10) Patent No.: US 6,668,472 B2
(45) Date of Patent: Dec. 30, 2003

(54) WEDGE-LOCKING SYSTEM AND EXCAVATION BUCKET ASSEMBLY WITH WEDGE-LOCKING SYSTEM

(76) Inventor: Robert Bierwith, 1331 Eastshore Hwy., Berkeley, CA (US) 94710

( * ) Notice: Subject to any disclaimer, the term of this patent is extended or adjusted under 35 U.S.C. 154(b) by 0 days.

(21) Appl. No.: 10/196,570

(22) Filed: Jul. 15, 2002

(65) Prior Publication Data

US 2003/0037467 A1 Feb. 27, 2003

Related U.S. Application Data

(60) Provisional application No. 60/305,979, filed on Jul. 16, 2001.

(51) Int. Cl.[7] ..... E02F 9/28

(52) U.S. Cl. ..... 37/455

(58) Field of Search ..... 37/455, 456, 457, 37/458; 403/345, 357, 372, 376, 377, 328; 172/701.1, 701.3

(56) References Cited

U.S. PATENT DOCUMENTS 3,312,004 A * 4/1967 Johnson ..... 37/457
5,526,592 A 6/1996 Bierwith
5,680,717 A 10/1997 Bierwith
6,032,390 A 3/2000 Bierwith
6,151,812 A 11/2000 Bierwith
6,216,368 B1 4/2001 Bierwith
6,393,738 B1 5/2002 Bierwith
6,415,533 B2 7/2002 Bierwith
2003/0037468 A1 * 2/2003 Adamic et al. ..... 37/455

* cited by examiner

*Primary Examiner*—Robert E. Pezzuto
*Assistant Examiner*—Meredith Petravick
(74) *Attorney, Agent, or Firm*—Townsend and Townsend and Crew LLP

(57) ABSTRACT

A locking system for coupling a first member including an aperture, and a second member having a receiving region is disclosed. The locking system comprises: (a) an interference element including (i) a first portion that fits within the aperture when the locking system couples the first member and the second member together, (ii) a second portion, wherein the first portion forms an angle with respect to the second portion, and (iii) a protrusion that extends into the receiving region when the locking system is in use; and (b) a locking element that engages the second portion of the interference element when the locking system is in use.

19 Claims, 7 Drawing Sheets

WEDGE-LOCKING SYSTEM AND EXCAVATION BUCKET ASSEMBLY WITH WEDGE-LOCKING SYSTEM

CROSS-REFERENCE TO RELATED APPLICATIONS

This application claims the benefit of U.S. Provisional Patent Application No. 60/305,979, filed Jul. 16, 2001. This U.S. Provisional Application is herein incorporated by reference in its entirety.

BACKGROUND OF THE INVENTION

Excavation bucket assemblies are used in the construction and mining. The bucket assemblies are used with a variety of different excavating apparatuses such as backhoes, power shovels, front-end loaders, dragline equipment, etc. Excavation bucket assemblies typically have a bucket body with a rear wall, sidewalls, and a bottom wall. The walls cooperatively define a region where excavated material can be contained and moved. The bottom, front edge of the bucket body can be coupled to a lip. Tooth assemblies are coupled to the lip to form an excavation bucket assembly.

Each tooth assembly can include an adaptor and a tooth. The adaptor can be coupled to the lip and a tooth can be coupled to the adaptor. Pins can be used to couple the parts of the tooth assembly together and can be used to couple the tooth assembly to the lip. When a tooth becomes worn or damaged, the pin coupling the tooth to its corresponding adapter can be removed so that the tooth can be uncoupled from the adaptor. A new tooth is then mounted in the place of the worn or damaged tooth.

During the tooth replacement process, the pin is knocked out with a large hammer. If the pin is damaged during this process, it is replaced with a new pin. Frequently replacing broken pins is undesirable as doing so increases the cost of maintaining the excavation bucket assembly. Moreover, using a large hammer to remove a pin can be dangerous. When striking the pin with a hammer, flying debris such as metal chips and sand can be created. The flying debris can potentially harm persons in the vicinity of the hammering.

An improvement over the conventional pin-based coupling systems is described in U.S. Pat. No. 6,216,368 by the same inventor as the present invention. FIG. 1 shows an embodiment in the U.S. patent. FIG. 1 shows the wedge-locking system 101 that couples an adaptor 106 and a tooth 105 together without the use of pins. Other details about the wedge-locking system 101 are described in the U.S. patent, which is herein incorporated by reference in its entirety for all purposes. As shown in FIG. 1, the wedge-locking system 101 is present in a depression 102 in the adaptor 106. In this example, the depression 102 is in the form of a rectangle and is defined by four slightly raised walls.

Over a period of time, particles such as grit or sand can get into the depression 102 and can abrade the parts of the wedge-locking system 101 and the adaptor 106. Accordingly, when the operator uncouples the adaptor 106 and the tooth 105, the operator also cleans the depression 102 of sand and grit. If the operator does not clean the depression 102 well, particles can remain in the depression 102. When the wedge-locking system 101 is in use, the particles lodged in the depression 102 can continue to abrade the parts of the wedge-locking system 101 and the adaptor 106. The abrasion reduces the useful life of the wedge-locking system 101 and the adaptor 106. More frequent replacement of the wedge-locking system 101 parts and the adaptor 106 may be required.

Embodiments of the invention address these and other problems.

SUMMARY OF THE INVENTION

One embodiment of the invention is directed to a locking system for coupling a first member including an aperture, and a second member having a receiving region, the locking system comprising: (a) an interference element including (i) a first portion that fits within the aperture of the first member when the locking system couples the first member and the second member together, and (ii) a second portion, wherein the first portion forms an angle with respect to the second portion, and (iii) a protrusion that extends into the receiving region of the second member when the locking system is in use; and (b) a locking element that engages the second portion of the interference element when the locking system is in use.

Another embodiment of the invention is directed to an assembly comprising: a first member including an aperture; a second member having a receiving region and a recess; and a locking system that couples the first member to the second member, wherein the locking system comprises (a) an interference element including (i) a first portion disposed within the aperture of the first member, (ii) a second portion, wherein the first portion forms an angle with respect to the second portion, and (iii) a protrusion that extends into the receiving region of the second member, and (b) a locking element that engages the second portion of the interference element and that is in the recess.

Another embodiment of the invention is directed to an excavation bucket assembly comprising: a bucket body; and a plurality of tooth assemblies coupled to the bucket body, wherein each tooth assembly includes an adaptor including an aperture, a tooth having a receiving region, and a locking system that couples the first member to the second member, wherein the locking system comprises (a) an interference element including (i) a first portion disposed within the aperture of the first member, and (ii) a second portion, wherein the first portion forms an angle with respect to the second portion, and (iii) a protrusion that extends into the receiving region, and (b) a locking element that engages the second portion of the interference element.

DETAILED DESCRIPTION

Figure 2:
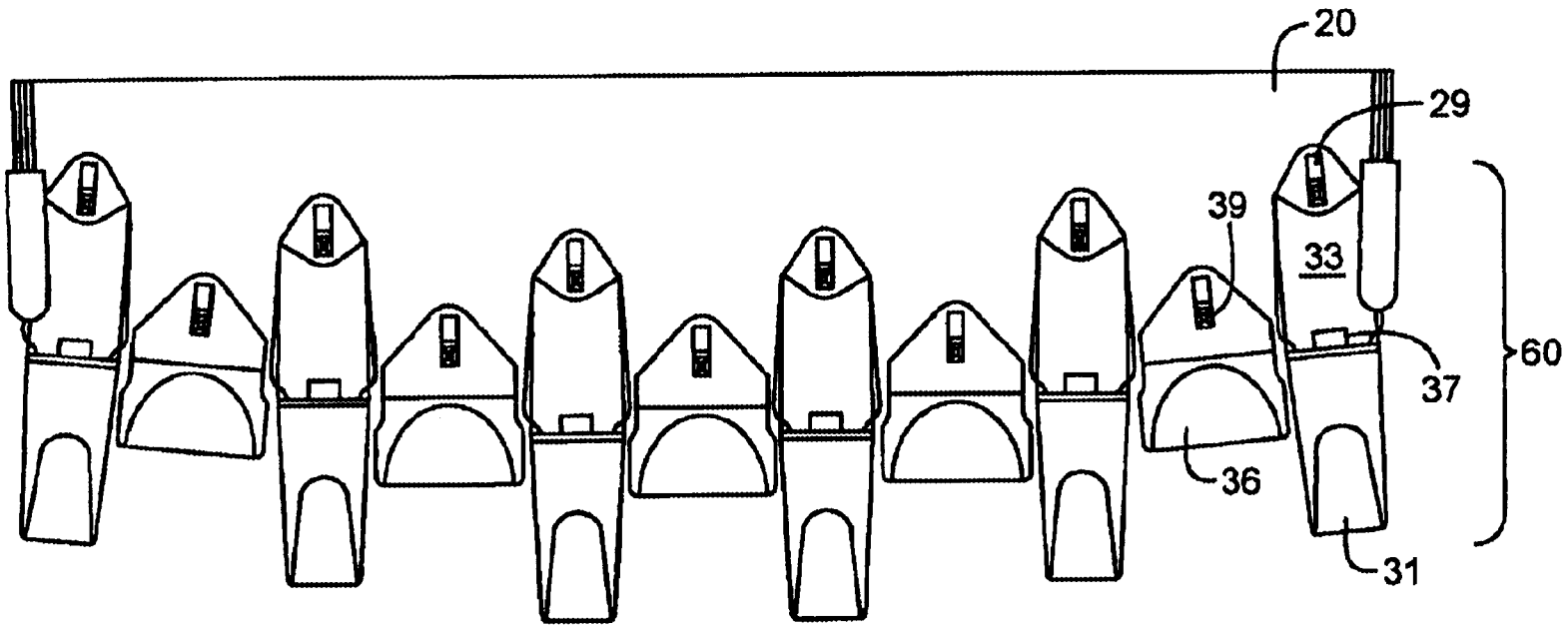
FIG. 2 shows a lip assembly with a plurality of tooth assemblies coupled to a lip.

FIG. 2 shows top plan view of a lip assembly according to an embodiment of the invention. The lip assembly includes a lip 20. A plurality of tooth assemblies 60 is coupled to the lip 20. Each tooth assembly 60 extends in a forward direction away from the lip 20. Each tooth assembly 60 includes an adaptor 33 and a tooth 31. The adaptor 33 and the tooth 31 are coupled together by a wedge-locking system 37. An adaptor shroud (not shown) may optionally cover the front portion of the adaptor 33. An interconnection mechanism 29 can couple the adaptor 33 to the lip 20. The interconnection mechanism 29 can include pins, C-clamps, or even the same or similar type of wedge-locking system that is used to couple the adaptor 33 and the tooth 31 together. Lip shrouds 36 are respectively disposed between adjacent tooth assemblies 60. The lip shrouds 36 protect the lip 20 from wear. A bucket body (not shown) may be coupled to the rear end of the lip 20 (i.e., on the opposite side as the tooth assemblies 60) to form a bucket assembly. The bucket body can be added to the rear end of the lip 20, and may include a bottom, sidewalls, and a rear wall. Typically, some or all of the parts of the lip assembly are made of a hard metal such as carbon steel.

In the example shown in FIG. 2, each adaptor 33 can be considered a first member and each tooth 31 may be considered a second member. Although adaptors and teeth are discussed for purposes of illustration, it is understood that the wedge-locking system 37 can be used to couple any suitable first and second members together. For example, the first and second members need not be parts of a lip assembly or even an excavation bucket assembly. In some embodiments, it is possible to use the wedge-locking system to couple a compaction element for a compactor to a compactor wheel. The compactor may be used, for example, to pack trash in a landfill.

Figure 3:
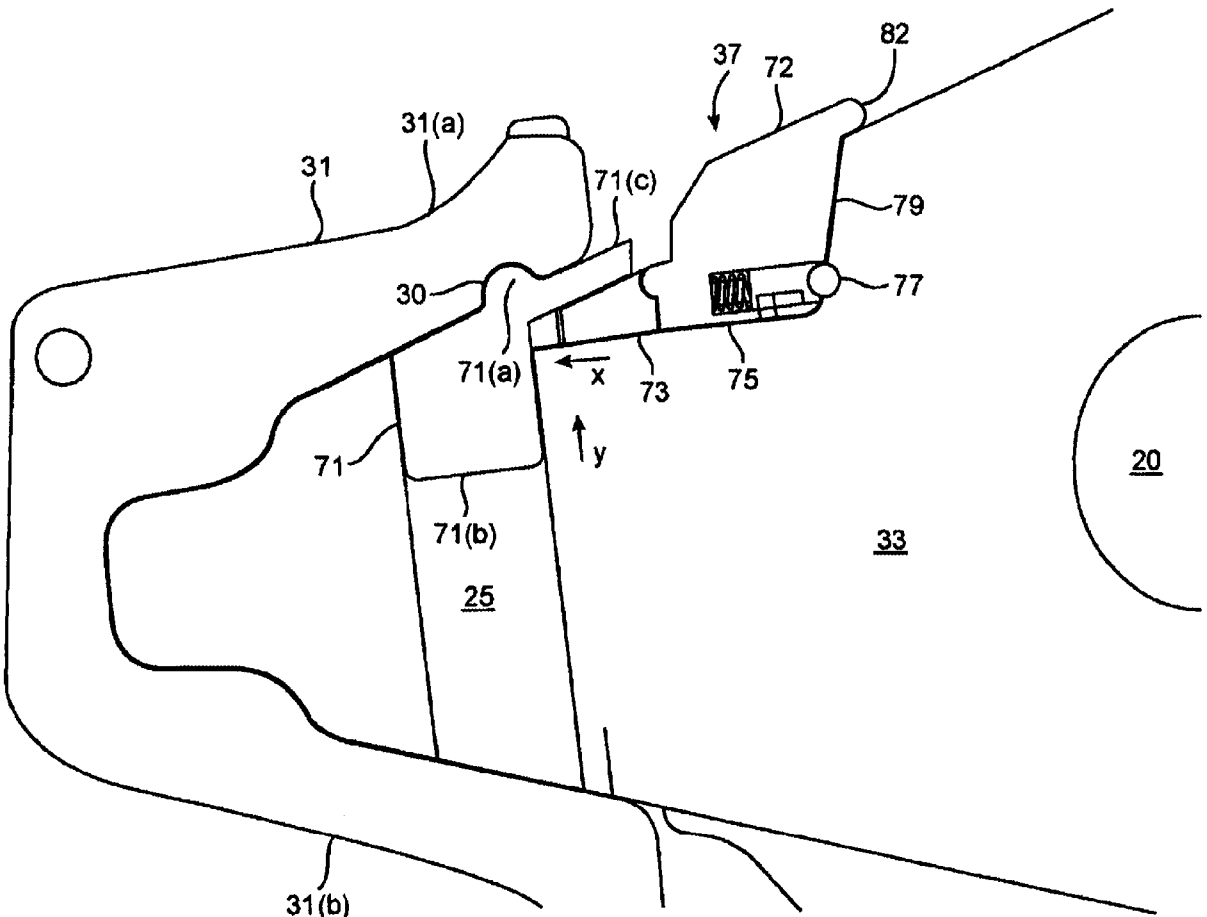
FIG. 3 shows a cross-sectional view of a portion of a lip assembly in a region where a wedge-locking system according to an embodiment of the invention would be used.

FIG. 3 shows a side-cross-sectional view of one embodiment of the invention. In this example, a locking system 37 couples a tooth 31 and an adaptor 33 together. The adaptor 33 is secured to a lip 20, and includes a recess 75 that is substantially defined by three walls. The three walls include a rear abutment wall 79 and two sidewalls (not shown). A front region of the recess 75 does not have a wall. In this example, the recess 75 can be in the form of a wedge that is defined by two sidewalls, a bottom surface, and a rear abutment wall 79.

An aperture 25 passes through the adaptor 33. Alternatively, the aperture 25 can pass through only a portion of the adaptor 25. The tooth 31 may include two legs 31(*a*), 31(*b*). One of the legs 31(*a*) can have a receiving region 30 on its underside. The tooth 31 is coupled to the adaptor 33 using the wedge-locking system 37.

In this example, the wedge-locking system 37 includes an interference element 71, a locking element 73, and a biasing element 72. These three elements 71, 72, 73 work together to secure the tooth 31 to the adaptor 33.

The interference element 71 can be a single body made of metal. It can include a protrusion 71(*a*), a first portion 71(*b*), and a second portion 71(*c*). In this example, the first portion 71(*b*) and the second portion 71(*c*) form an angle. The first portion 71(*b*) extends into the aperture 25 in the adaptor 33, while the second portion 71(*c*) is outside of the aperture 25. The interference element 71 can move up and down while the walls of the aperture 25 constrain the lateral movement of the interference element 71. The protrusion 71(*a*) can fit within and may be cooperatively structured with the receiving region 30 of the tooth 31. In this example, the receiving region 30 extends through a portion of the leg 31(*a*). In other examples, the receiving region 30 can form part of a hole that extends from one side of the leg 31(*a*) to the other side of the leg 31(*a*).

The locking element 73 in this example is in the form of a wedge. It includes an upper surface that is at an angle with respect to a lower surface of the locking element 73. When the locking element 73 moves forward (e.g., in the direction x), it engages the second portion 71(*c*) of the interference element 71 and pushes the interference element 71 upward (e.g., in the direction y) until the protrusion 71(*a*) is received in the receiving region 30 of the tooth 31. Moving the locking element 73 in a forward lateral direction causes the interference element 71 to move upward in a direction substantially perpendicular to the lateral direction. Once the protrusion 71(*a*) is in the receiving region 30, the tooth 31 and the adaptor 33 are coupled together.

When the tooth 31 and the adaptor 33 are coupled together, a biasing element 72 can apply pressure to the locking element 73 so that the locking element 73, the interference element 71, and the tooth 31 are all engaged. A spring 75 in the biasing element 72 can push a pin 77 into a cooperatively structured slot in the adaptor 33 to secure the biasing element 72 to the adaptor 33.

Variations in the illustrated embodiment are possible. For example, although one specific type of biasing element 72 is shown in FIG. 3, the biasing element could be any other suitable device that can apply pressure to the locking element 73. For example, the biasing element could be one or two elastomeric blocks that can push the locking element 73 under the second portion 71(*c*) of the interference element 71. In yet another embodiment, it is possible to have a bolt or other securing device pass through the biasing element 72 and to the adaptor 33 to secure the biasing element 75 to the adaptor 33. This can provide even greater stability to the locking system. Other embodiments are also within the scope of the invention. For example, in some embodiments, the locking element 73 and the biasing element 72 could form a one-piece construction. Any of the features that are described herein with respect to a two-piece locking element/biasing element combination could be included in the one-piece locking element.

An operator can uncouple the tooth 31 and the adaptor 33 by using, for example, a crowbar or the like. A crowbar can be inserted under a rim 82 of the biasing element 72 to pry the biasing element 72 away from the adaptor 33. The biasing element 72 is then removed. Any pressure that was previously applied to the locking element 73 is released. The locking element 73 can be disengaged from the interference element 71 by moving it in a rearward direction. Moving the locking element 73 in a rearward direction causes the interference element 71 to move downward. The protrusion 71(*a*) then disengages from the receiving region 30 of the tooth 31. The interference element 71 can then be removed and the tooth 31 and the adaptor 33 can be separated from each other.

Figure 1:
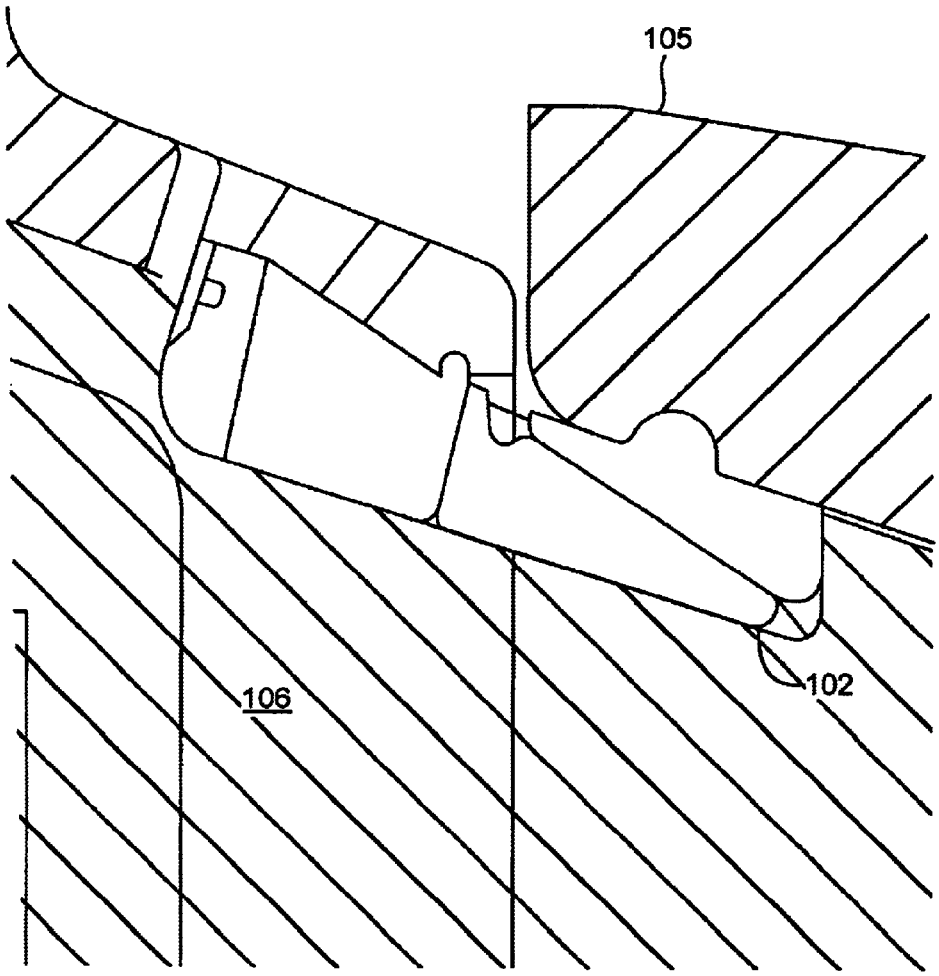
FIG. 1 shows a cross-sectional view of a wedge-locking system that is present in a depression in an adaptor.

The embodiment shown in FIG. 3 has a number of advantages. First, the wedge-locking system 37 does not need to use a pin to couple the adaptor 33 and the tooth 31 together. Accordingly, hammers need not be used and embodiments of the invention are safer than the conventional pin-based coupling systems. Second, because pins need not be used, the costs associated with damaged pins are eliminated. Third, in embodiments of the invention, the adaptor 33 can be thoroughly cleaned without difficulty. For example, when the tooth 31 and the adaptor 33 are uncoupled from each other, the elements 71, 72, 73 of the locking system 37 can be removed. The recess 75 that receives and supports the locking element 73 and the biasing element 72 can be easily cleaned. For example, particles such as grit and sand can be removed from the recess 75 by simply brushing the particles in a forward direction so that they pass down the aperture 25 of the adaptor 33 or through the wall-less front region of the recess 75. Unlike the assembly shown in FIG. 1, the recess 75 does not include a forward wall that obstructs the removal of particles from the recess 75. Particles that might otherwise abrade the parts of the locking system 37 can be easily removed from the adaptor 33. Consequently, embodiments of the invention using the locking system 37 mechanism are subject to less wear and a longer working life than assemblies using conventional coupling mechanisms.

Figure 4:
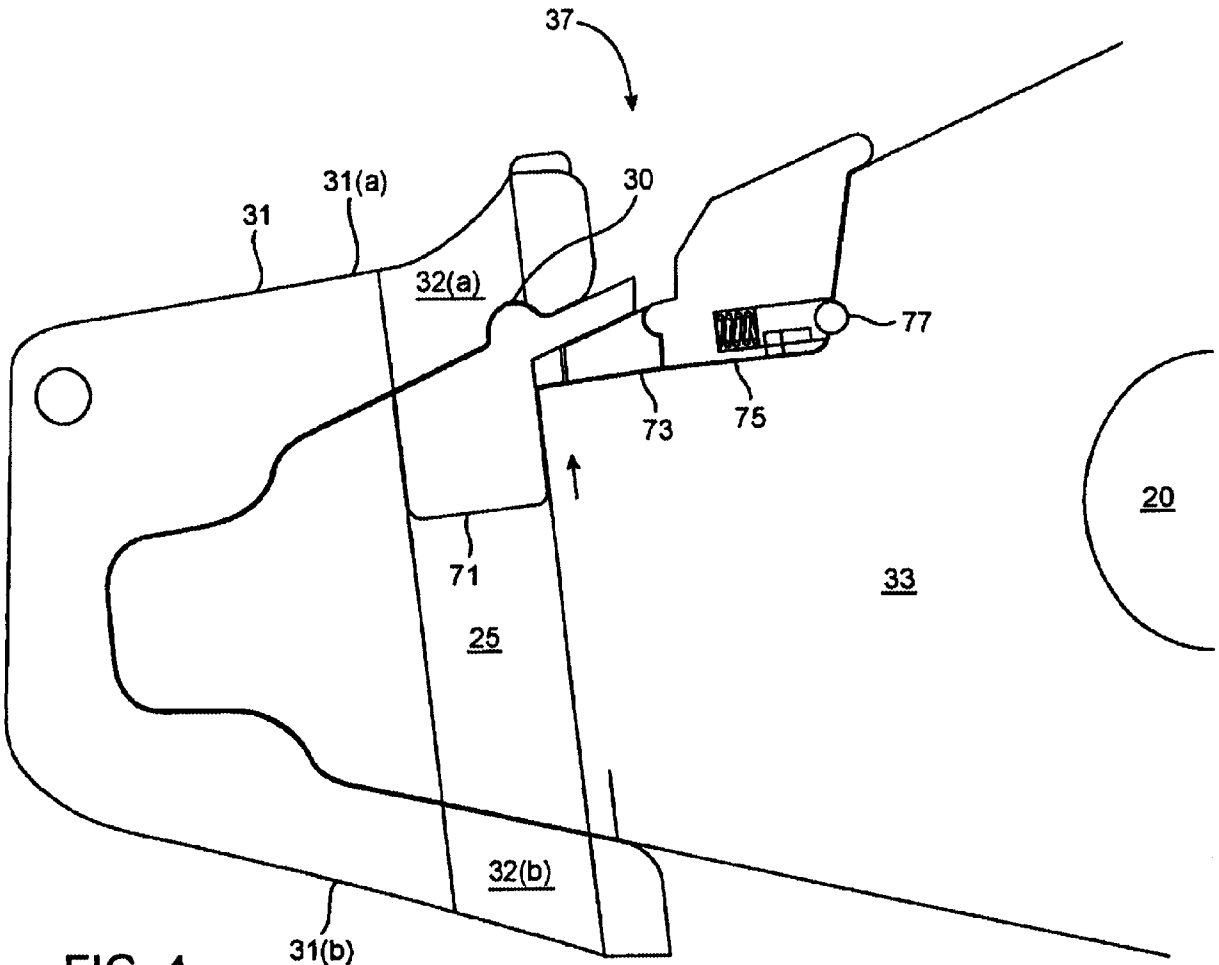
FIG. 4 shows a cross-sectional view of a portion of a lip assembly in a region where a locking system according to an embodiment of the invention would be used. In this Figure, the tooth has a hole that extends through a leg of the tooth.

FIG. 4 shows another embodiment of the invention. In FIG. 4, features that are similar to those shown in FIG. 3 have the same numbering. However, in the embodiment shown in FIG. 4, the two legs 31(*a*), 31(*b*) have holes 32(*a*), 32(*b*) in them. Each hole 32(*a*), 32(*b*) extends to opposite sides of each of the respective legs 31(*a*), 31(*b*). The receiving region 30 in the upper leg 31(*a*) is part of the hole 32(*a*) in that leg 31(*a*). If desired, the holes 32(*a*) can be temporarily plugged or sealed with a suitable material to reduce the amount of debris that might enter the holes 32(*a*), 32(*b*).

The embodiment shown in FIG. 4 can advantageously be converted to a pin-based coupling system if desired. For instance, the elements 71, 73, 75 could be removed. A pin could be threaded through the holes 32(*a*), 32(*b*) in the tooth 31 and through the aperture 25 in the adaptor 33 to couple the adaptor 33 and the tooth 31 together. Having a convertible assembly is desirable if, for example, the wedge-locking system elements become worn and are not readily available at the operator's worksite.

Figure 5:
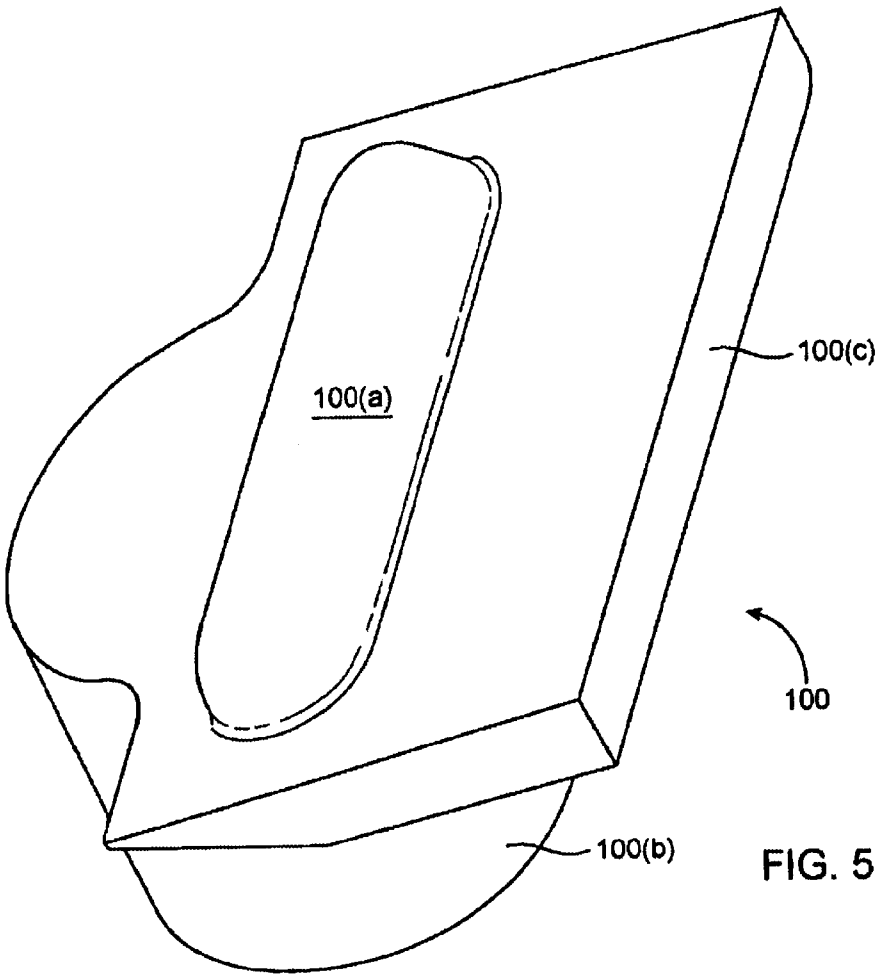
FIG. 5 shows an interference element according to an embodiment of the invention.

FIG. 5 shows an interference element according to an embodiment of the invention. In this embodiment, the interference element 100 has a protrusion 100(*a*), a first portion 100(*b*) that is generally cylindrical, and a second portion 100(*c*) that is generally flat. The first portion 100(*b*) and the second portions 100(*c*) are at an angle. The protrusion 100(*a*) has an oblong cross-sectional shape. However, in other embodiments, the protrusion could have a circular cross-sectional shape (e.g., as in a cylinder), a square cross-sectional shape (e.g., as in a block), etc.

Figure 6:
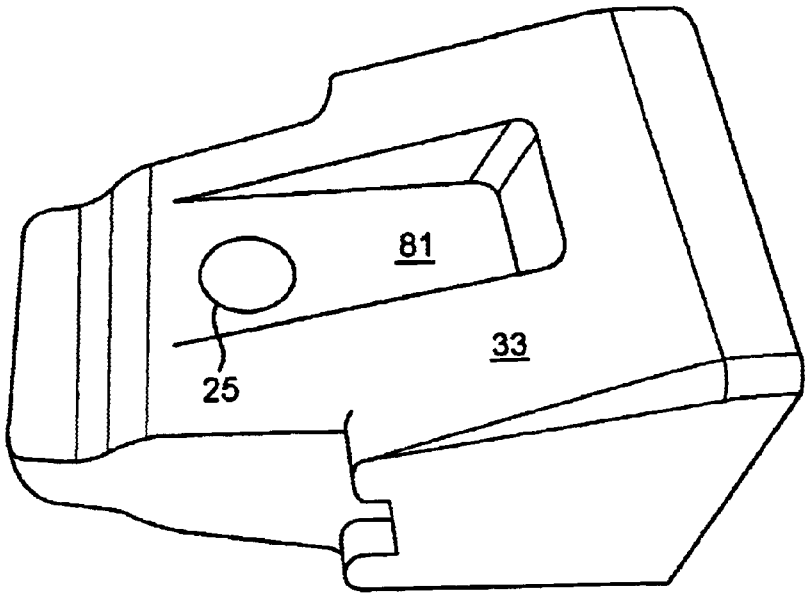
FIG. 6 shows a perspective view of an adaptor according to an embodiment of the invention.

FIG. 6 shows a perspective view of an adaptor 33 according to an embodiment of the invention. The adaptor 33 includes a recess 81 and an aperture 25. In this example, the aperture 25 is in the recess 81. As shown, the recess 81 has a rear abutment wall that slopes downward in a forward direction, and two sidewalls. Each sidewall has a height that gradually decreases from the top of the abutment wall towards the front of the adaptor 33. The front region of the recess 81 does not include a wall. Advantageously, an operator can readily clean the recess 81 by simply scraping, brushing, or blowing debris (e.g., sand, dirt, and rocks) from the deepest part of the recess 81 near the abutment wall towards the wall-less front region of the recess 81. The debris can pass down the aperture 25 in the adaptor 33 and off the front of the adaptor 33. In embodiments of the invention, there are many different paths through which debris can be removed from the recess 81 so that the recess 81 can be thoroughly cleaned. After cleaning, the recess 81 is substantially free of debris (e.g., particles).

Figure 7:
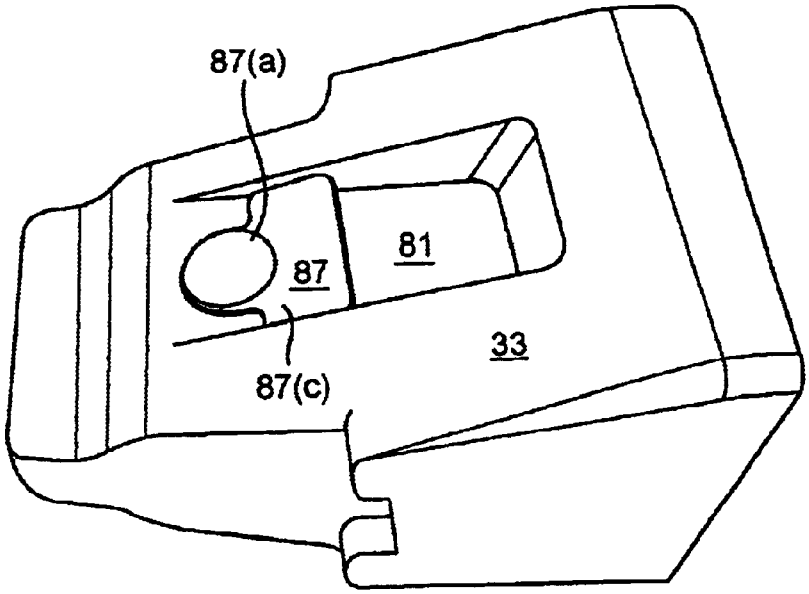
FIG. 7 shows a perspective view of an adaptor and an interference element according to an embodiment of the invention.

FIG. 7 shows a perspective view of an interference element 87, a first portion of which is disposed in the aperture of the adaptor 33. In this example, the interference element 87 includes a protrusion 87(*a*) that is round. The second portion 87(*c*) of the adaptor 33 is substantially flat and has a width that is substantially equal to the width of the recess 81.

In this embodiment, the interference element 87 can also be used as a cleaning tool as well as a part of a locking system. Since the interference element 87 is used to secure the tooth to the adaptor 33, and is essentially always present near the recess 81 in the adaptor 33, a cleaning tool is always readily available for the operator to use. An operator can grasp the substantially cylindrical first portion (not shown) of the interference element 87 and can use the second portion 87(*c*) of the interference element 87 to scrape and remove debris from the recess 81. For example, the operator can insert the second portion 87(*c*) of the interference element 87 into the recess 81 near the rear abutment wall. The operator can then move the interference element forward while keeping the second portion 87(*c*) in contact with the bottom surface of the recess 81. Debris such as particles pass up the sloping bottom wall, into the aperture in the adaptor 33 or past the wall-less front region of the recess 81, and off of the adaptor 33.

Figure 8:
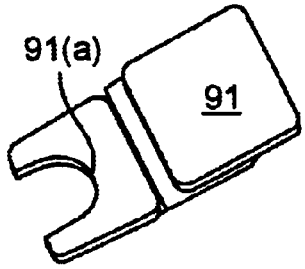
FIG. 8 shows a perspective view of a locking element according to an embodiment of the invention.

FIG. 8 shows a top perspective view of a one-piece locking element. As shown, the locking element 91 includes a biasing portion that is proximate the rear of the adaptor 33 and a wedge-shaped front portion 91(*a*) that is proximate the front of the adaptor 33. The wedge-shaped front portion 91(*a*) has cutout area for receiving the substantially cylindrical first portion of the interference element 87. Generally, the biasing portion is thicker than the wedge-shaped front portion 91(*a*).

Figure 9:
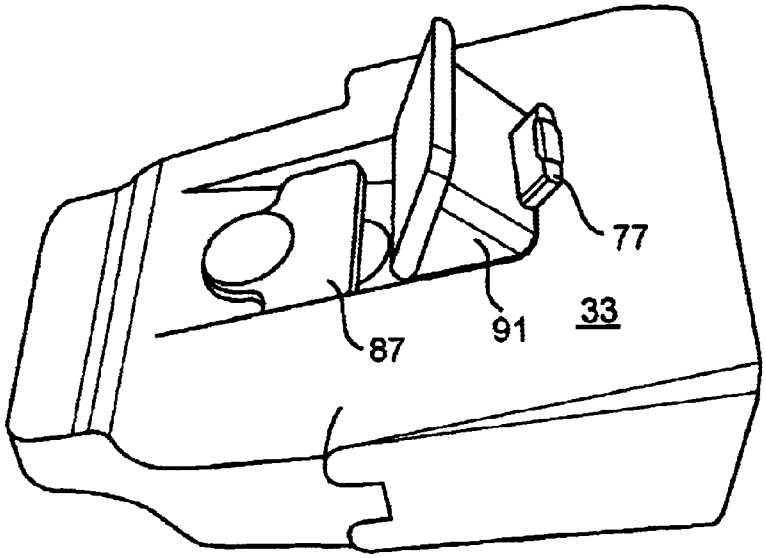
FIG. 9 shows a perspective view of a locking element, an adaptor, and an interference element according to an embodiment of the invention.

As shown in FIG. 9, the locking element 91 can be inserted under the interference element 87 so that the wedge-shaped front portion 91(*a*) engages both the substantially cylindrical first portion and the substantially flat second portion of the interference element 87. The cutout area engages the cylindrical first portion of the interference element 87. The wedge-shaped front portion pushes the interference element 91 up as the locking element 87 is pushed toward the interference element 91. A rectangular pin 77 that is biased with an internal spring then engages a slot in the adaptor to secure the locking element 91 to the adaptor 33.

The terms and expressions which have been employed herein are used as terms of description and not of limitation, and there is no intention in the use of such terms and expressions of excluding equivalents of the features shown and described, or portions thereof, it being recognized that various modifications are possible within the scope of the invention claimed. Moreover, any one or more features of any embodiment of the invention may be combined with any one or more other features of any other embodiment of the invention, without departing from the scope of the invention.

What is claimed is:

1. A locking system for coupling a first member including an aperture, and a second member having a receiving region, the locking system comprising:

(a) an interference element including (i) a first portion that fits within the aperture of the first member when the locking system couples the first member and the second member together, (ii) a second portion, wherein the first portion forms an angle with respect to the second portion, and (iii) a protrusion that extends into the receiving region of the second member when the locking system is in use; and (b) a locking element that engages the second portion of the interference element when the locking system is in use.

2. The locking system of claim 1 wherein the locking element has an angled surface that is cooperatively structured with a surface of the second portion of the interference element, and wherein movement of the locking element in a first direction causes the interference element to move in a second direction that is substantially perpendicular to the first direction.

3. The locking system of claim 1 further comprising a biasing element that is adapted to provide a biasing force against the locking element when the locking system is in use.

4. The locking system of claim 1 wherein the second portion of the interference element is substantially flat and wherein the first portion of the interference element is substantially cylindrical.

5. The locking system of claim 1 wherein the interference element and the locking element comprise steel.

6. An assembly comprising:

a first member including an aperture;

a second member having a receiving region and a recess; and a locking system that couples the first member to the second member, wherein the locking system comprises (a) an interference element including (i) a first portion disposed within the aperture of the first member, (ii) a second portion, wherein the first portion forms an angle with respect to the second portion, and (iii) a protrusion that extends into the receiving region of the second member, and (b) a locking element that engages the second portion of the interference element and that is in the recess.

7. The assembly of claim 6 wherein the first member is an adaptor and the second member is a tooth.

8. The assembly of claim 6 wherein the locking element has an angled surface that is cooperatively structured with a surface of the second portion of the interference element, and wherein movement of the locking element in a first direction causes the interference element to move in a second direction that is substantially perpendicular to the first direction.

9. The assembly of claim 6 further comprising a biasing element that provides a biasing force against the locking element.

10. The assembly of claim 6 wherein the second portion of the interference element is substantially flat and wherein the first portion of the interference element is substantially cylindrical.

11. The assembly of claim 6 wherein the first member is an adaptor and the second member is a tooth with a pair of legs, and wherein the aperture in the adaptor extends through the adaptor and wherein the receiving region forms part of a hole that extends through one of the legs of the tooth.

12. The assembly of claim 6 wherein the locking element includes a wedge-shaped portion and a biasing portion.

13. The assembly of claim 6 wherein the first member, the second member, the interference element, and the locking element comprise steel.

14. The assembly of claim 6 wherein the recess is defined by a sloping surface that is bounded by sidewalls and an endwall.

15. An excavation bucket assembly comprising:

a bucket body; and a plurality of tooth assemblies coupled to the bucket body, wherein each tooth assembly includes an adaptor including an aperture, a tooth having a receiving region, and a locking system that couples the first member to the second member, wherein the locking system comprises (a) an interference element including (i) a first portion disposed within the aperture of the first member, and (ii) a second portion, wherein the first portion forms an angle with respect to the second portion, and (iii) a protrusion that extends into the receiving region, and (b) a locking element that engages the second portion of the interference element.

16. The excavation bucket assembly of claim 15 further comprising a lip, wherein the lip is coupled to the bucket body and also to the plurality of tooth assemblies.

17. The excavation bucket assembly of claim 15 wherein the locking element has an angled surface that is cooperatively structured with a surface of the second portion of the interference element, and wherein movement of the locking element in a first direction causes the interference element to move in a second direction that is substantially perpendicular to the first direction.

18. The excavation bucket assembly of claim 15 further comprising a biasing element that provides a biasing force against the locking element.

19. The excavation bucket assembly of claim 15 wherein the second portion of the interference element is substantially flat and wherein the first portion of the interference element is substantially cylindrical.

* * * * *